US007066214B2

(12) United States Patent
Speich et al.

(10) Patent No.: US 7,066,214 B2
(45) Date of Patent: Jun. 27, 2006

(54) NARROW FABRIC NEEDLE LOOM FOR PRODUCING A STRIP-SHAPED TISSUE, AND CORRESPONDING STRIP-SHAPED TISSUE

(75) Inventors: Francisco Speich, Gipf-Oberfrick (CH); Walter Studer, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 376 days.

(21) Appl. No.: 10/239,947

(22) PCT Filed: Apr. 10, 2001

(86) PCT No.: PCT/CH01/00227

§ 371 (c)(1),
(2), (4) Date: Jul. 9, 2003

(87) PCT Pub. No.: WO01/77424

PCT Pub. Date: Oct. 18, 2001

(65) Prior Publication Data

US 2004/0040610 A1 Mar. 4, 2004

(30) Foreign Application Priority Data

Apr. 11, 2000 (CH) ..... 722/00

(51) Int. Cl.
*D03D 47/06* (2006.01)

(52) U.S. Cl. ..... 139/442; 139/431

(58) Field of Classification Search ..... 139/441–442, 139/431–432, 447, 383
See application file for complete search history.

(56) References Cited

U.S. PATENT DOCUMENTS

| | | | | |
|---|---|---|---|---|
| 819,138 | A * | 5/1906 | Herzig | 139/433 |
| 2,471,758 | A * | 5/1949 | Libby | 139/432 |
| 5,358,015 | A * | 10/1994 | Hacker et al. | 139/383 AA |

FOREIGN PATENT DOCUMENTS

| | | |
|---|---|---|
| CH | 598382 | 4/1978 |
| FR | 2356754 | 1/1978 |
| WO | WO 91/14814 | 10/1991 |

OTHER PUBLICATIONS

Hans Walter Kipp, "Bandwebtechnik", Heidelberg: Melliand, 1988 (pp. 84-91).

* cited by examiner

*Primary Examiner*—John J. Calvert
*Assistant Examiner*—Andrew W. Sutton
(74) *Attorney, Agent, or Firm*—Gordon & Rees LLP

(57) ABSTRACT

The invention relates to a narrow fabric needle loom, comprising a shedding device forming a shed, and a weft insertion needle (12) for at least one weft loop (14). A knitting needle (26) is provided on the discharge end (20) of the shed facing away from the feed end (18) of the weft insertion needle (12) and secures the weft loops (14) by meshing (22). A second knitting needle (36) that meshes (30) the loops is provided on the feed end (18) of the weft insertion needle (12). The knitting needles for the feed end (18) and the discharge end (20) are mounted so that they can be swiveled about the same rotational axis (47).

8 Claims, 7 Drawing Sheets

NARROW FABRIC NEEDLE LOOM FOR PRODUCING A STRIP-SHAPED TISSUE, AND CORRESPONDING STRIP-SHAPED TISSUE

TECHNICAL FIELD

The invention relates to a needle-type ribbon weaving machine for producing a ribbon fabric according to the preamble of claim 1 and to a ribbon fabric of this kind according to the preamble of claim 8.

PRIOR ART

A needle-type ribbon weaving machine and a ribbon fabric produced by it are known from CH-A-598 382. Due to the knitting needle present on the insertion side and on the discharge side, on the one hand, the needle-type ribbon weaving machine has a complicated construction and, on the other hand, the ribbon fabric is exposed, during production, to very high loads which make it possible for the ribbon fabric to be distorted. The production of the ribbon fabric is made difficult and is possible only with a low output.

PRESENTATION OF THE INVENTION

The object of the invention is to improve further a needle-type ribbon weaving machine and a ribbon fabric of the type initially mentioned.

The object is achieved, according to the invention, by: the needle-type ribbon weaving machine of claim 1; the ribbon fabric according to claim 8.

Since the knitting needles for the insertion side and the discharge side are pivotable about the same axis of rotation, this results in a construction which is simple and, in particular, symmetric on both ribbon sides and which is conducive to a tie-up which is the same on both ribbon sides, thus preventing the ribbon fabric from being distorted.

Since the needle-type ribbon weaving machine has a second knitting needle for interlacing on the insertion side of the weft insertion needle, a ribbon fabric can be produced which has an at least approximately identical appearance at both edges, that is to say on the insertion side of the weft insertion needle into the shed and on the discharge side of the weft insertion needle out of the shed. The technically superfluous interlacing on the insertion side of the weft thread loop into the shed gives the observer the impression that both ribbon edges of the ribbon fabric are identical. This initially leads at least to a visual improvement in the ribbon fabric. However, the interlacings at both ribbon edges of the ribbon fabric also results in a ribbon fabric construction which is identical or at least very similar on both sides, with the result that the physical properties of the ribbon fabric are improved. Thus, for example, a distortion of the ribbon fabric, in particular under load, is prevented. The resistivity of the two ribbon edges and consequently their susceptibility to wear are virtually the same. In particular, it was found that by the ribbon edges being interlaced, the adverse properties of the reversal points of monofilament weft threads are avoided. The harsh sawtooth-like ribbon edges which are formed by the reversal points of monofilament weft threads are smoothed out by the interlacing, so that the risks of material damage and/or personal injury are largely eliminated.

Advantageous refinements of the needle-type ribbon weaving machine are described in the dependent claims 2 to 7 and those of the ribbon fabric are described in the dependent claims 9 to 11.

The interlacing on the insertion side of the shed may be identical to or different from the interlacing on the discharge side. For the interlacing, there are numerous exemplary embodiments, such as, for example, the Müller weaving systems I to V described in KIPP, loc. cit., pages 84–94. The warp, weft and interlacing threads may consist of the most different possible materials and have the most different possible designs and dimensions. Particular advantages are afforded by a ribbon fabric having a weft thread consisting of a monofilament thread and interlacing threads consisting of multifilament threads.

BRIEF DESCRIPTION OF THE DRAWINGS

Exemplary embodiments of the invention are described in more detail below with reference to the drawings in which.

WAYS OF IMPLEMENTING THE INVENTION

Figure 1:
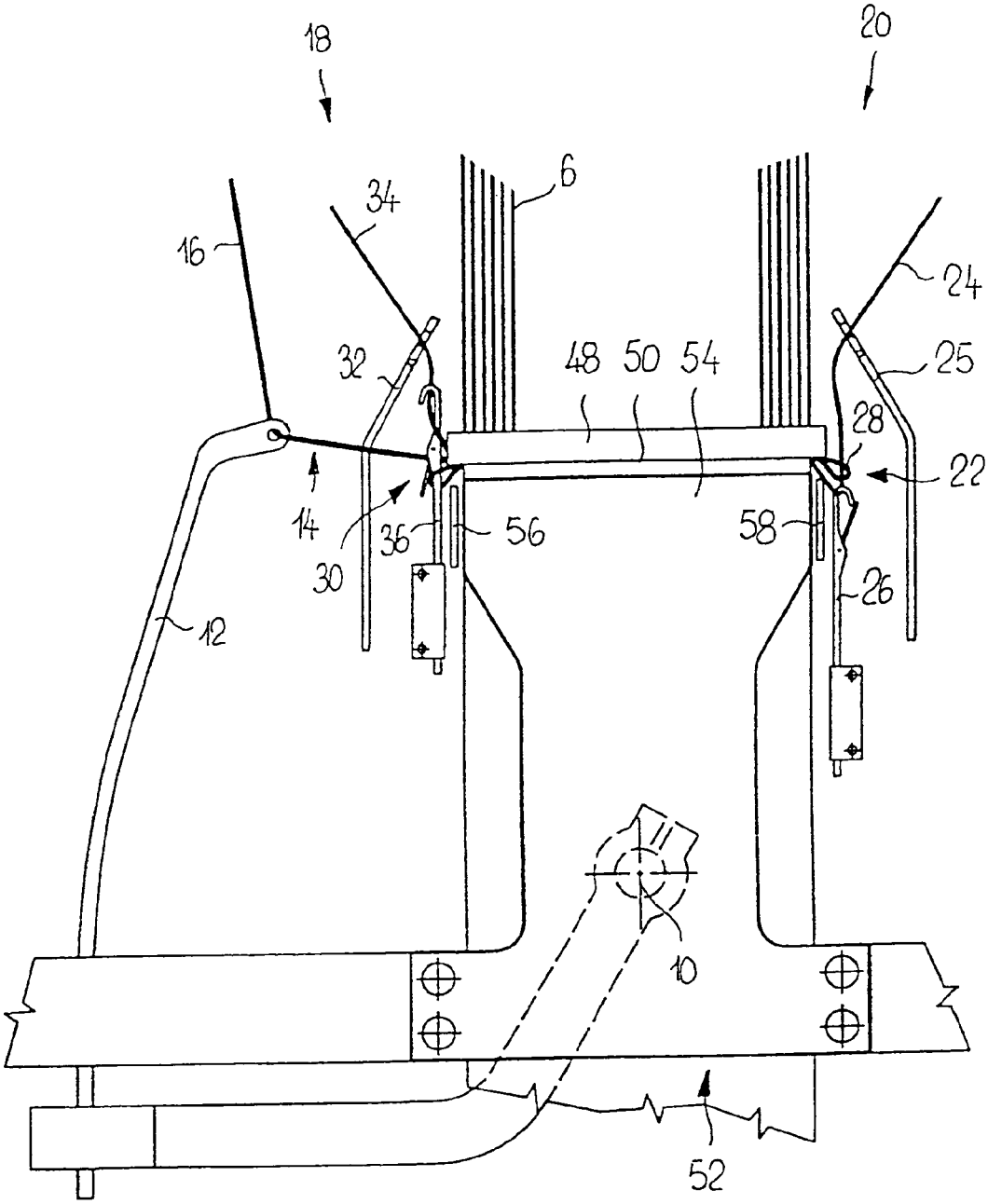
FIG. 1 shows the weaving region of a needle-type ribbon weaving machine in a top view.
Figure 2:
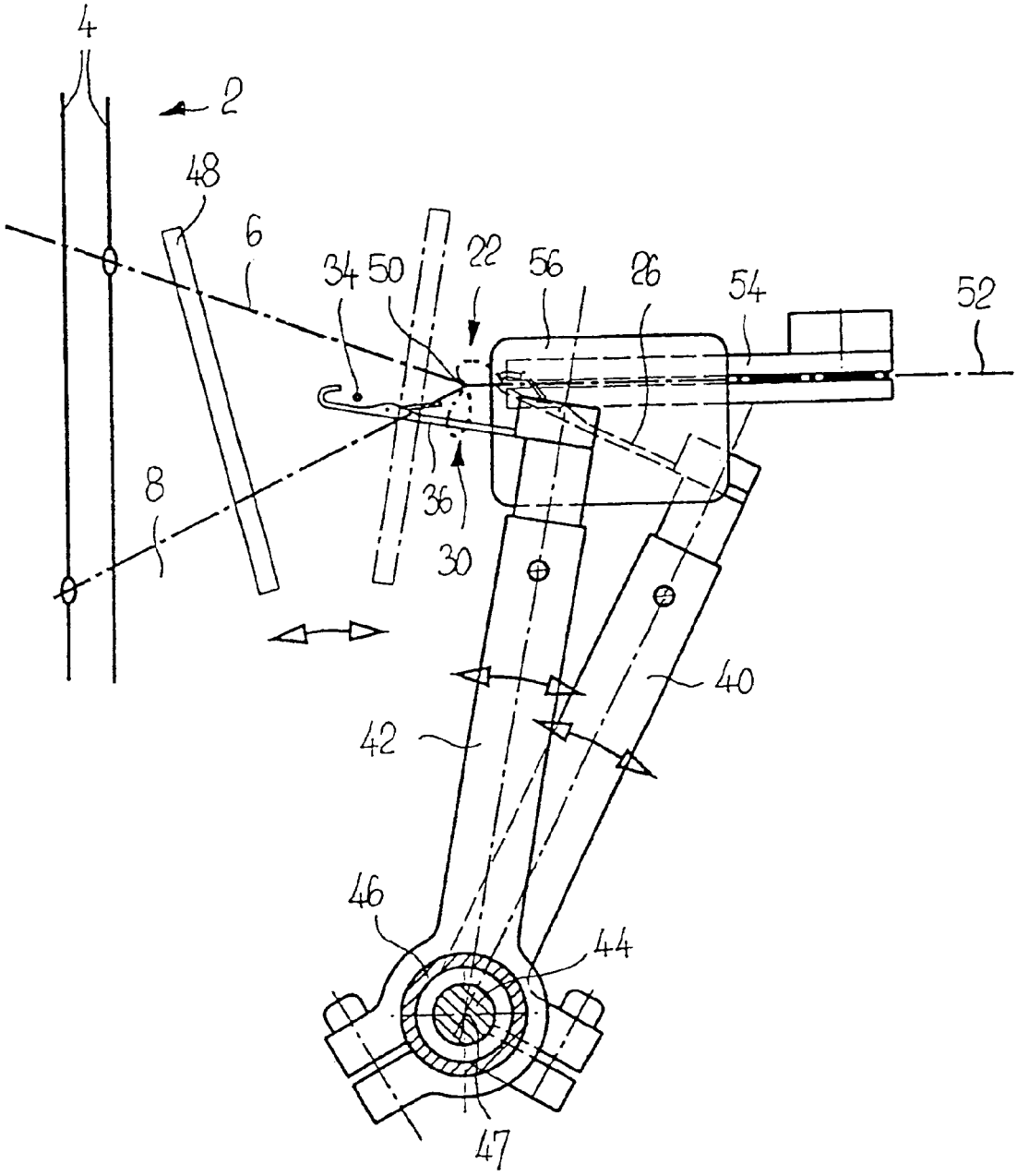
FIG. 2 shows a detail of the needle-type ribbon weaving machine according to FIG. 1 in a side view.

FIGS. 1 and 2 show the weaving region of a needle-type ribbon weaving machine in a diagrammatic illustration, only the parts essential for the invention being illustrated. A shedding device 2 contains pattern-controlled heddles 4 which open warp threads 6 according to a pattern program to form a shed 8. A weft insertion needle 12 oscillatable about an axis 10 inserts a weft thread loop 14 of a multifilament or monofilament weft thread 16 into the shed 8 on an insertion side 18. The weft insertion needle 12 and consequently the weft thread loop 14 project from the shed 8 on the discharge side 20, said weft thread loop being tied up there by means of an interlacing 22.

Figure 3:
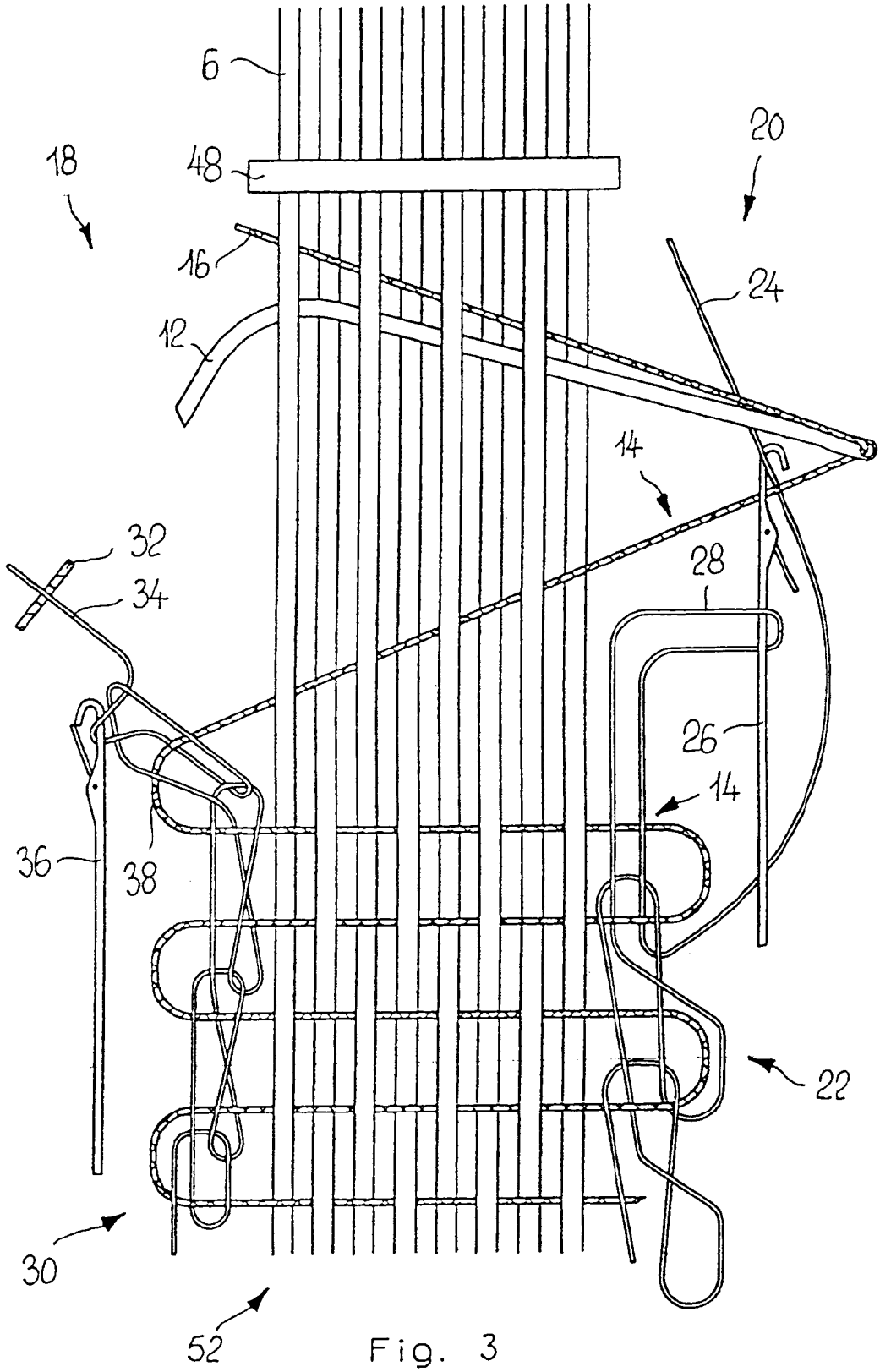
FIG. 3 shows the construction of a first ribbon fabric, in which a weft thread is tied up on both sides by means of an interlacing thread, according to the Müller weaving system II.

In the example of FIGS. 1 to 3, the interlacing is formed by a multifilament interlacing thread 24 which is supplied via a thread guide 25 and is drawn through the weft thread loop 14 by means of a first knitting needle 26 and interlaced with itself by means of a loop 28 consisting of the interlacing thread 24. This interlacing system is described as the Müller weaving system II in KIPP, loc. cit., page 86. On the insertion side 18, there is a further interlacing 30 which is formed in a similar way to the interlacing 22 of the discharge side 20. The interlacing 30 is formed by a multifilament interlacing thread 34 which is supplied via a thread guide 32 and which is drawn by means of a second knitting needle 36 through a connection point 38 between adjacent weft thread loops 14 and is interlaced with itself.

The knitting needles 26, 36 are arranged in each case on rockers 40, 42 which are fastened to coaxial shafts 44, 46 pivotable about an axis of rotation 47 and are driven with phase displacement. The phase displacement may be 90° to 270°. A phase displacement of 180° preferably corresponds to the position, offset at 180°, of the weft insertion needle 12 on the insertion side 18 or the discharge side 20.

Figure 4:
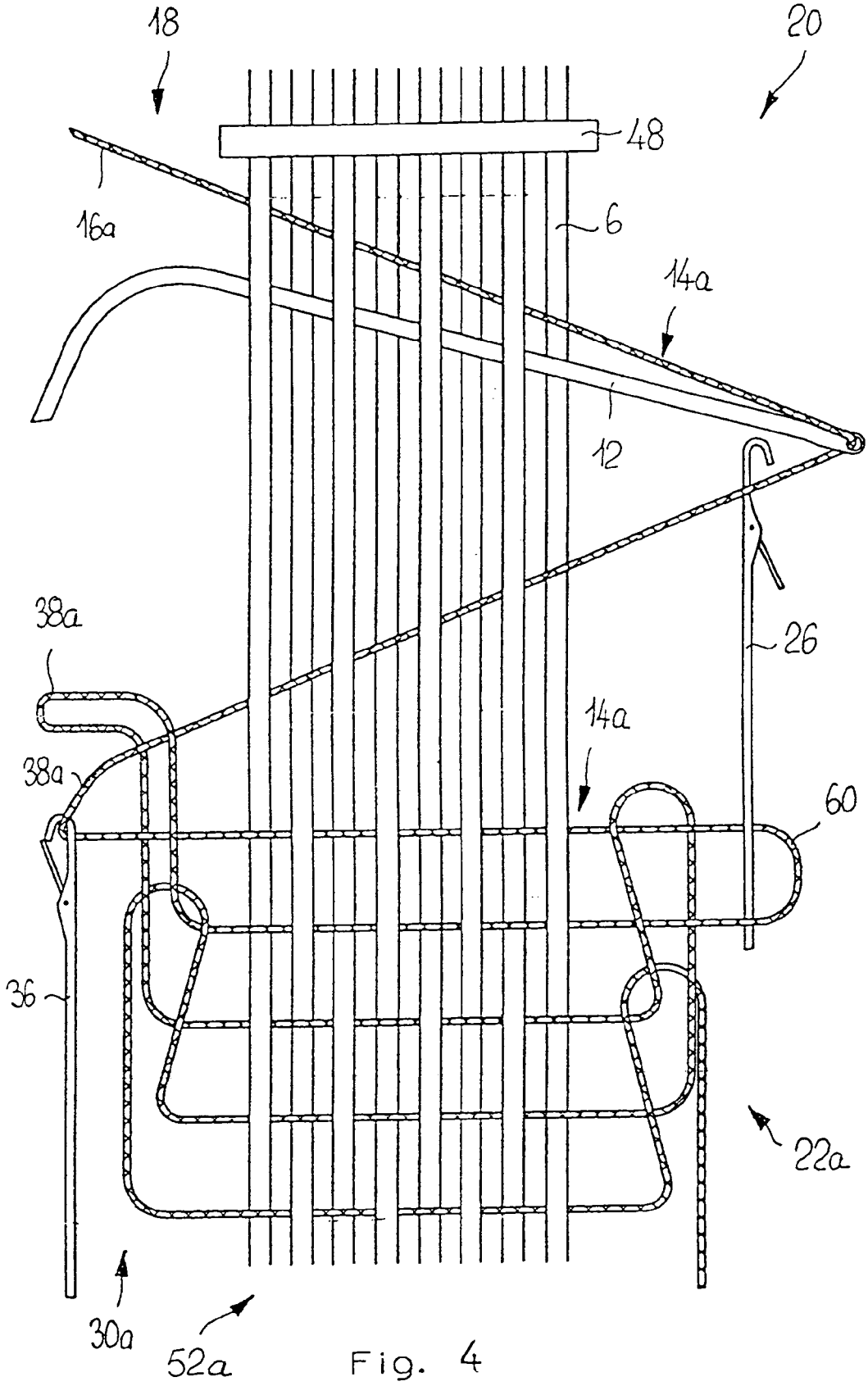
FIG. 4 shows the construction of a second ribbon fabric, in which the weft thread is tied up on both sides with itself, according to the Müller weaving system I.

The needle-type ribbon weaving machine also contains a weaving reed 48 which beats up the weft thread loop 14 inserted into the shed 8 at the beating-up edge 50 of the ribbon fabric 52. A ribbon guide 54 which follows the beating-up edge 50 extends at most over the entire width of the ribbon fabric 52 to be produced. The ribbon guide 54 ensures, downstream of the beating-up edge 50, a satisfactory guidance of the ribbon fabric 52 produced. This guidance is assisted by stitch knocking-over plates 56, 58 arranged on both sides of the ribbon guide 54, that is to say assigned to the insertion side 18 and to the discharge side 20 respectively. FIG. 4 shows a second ribbon fabric 52*a*, in which the weft thread 16*a* is introduced, as in the example of FIG. 3, by means of the weft insertion needle 12 into the shed formed from the warp threads 6. The weft thread 16*a* is looped together with itself both on the discharge side 20 and on the insertion side 18 by means of the first knitting needle 26 and the second knitting needle 36 respectively. The head parts 60 of the weft thread loops 14*a* are correspondingly interlaced with themselves during interlacing 22*a* on the discharge side 20. Similarly, the connection points 38*a* between adjacent weft thread loops 14*a* are interlaced with themselves by means of the second knitting needle 36 on the insertion side 18, as may be gathered from FIG. 4 This is the Müller weaving system I in KIPP, loc. cit., page 85.

Figure 5:
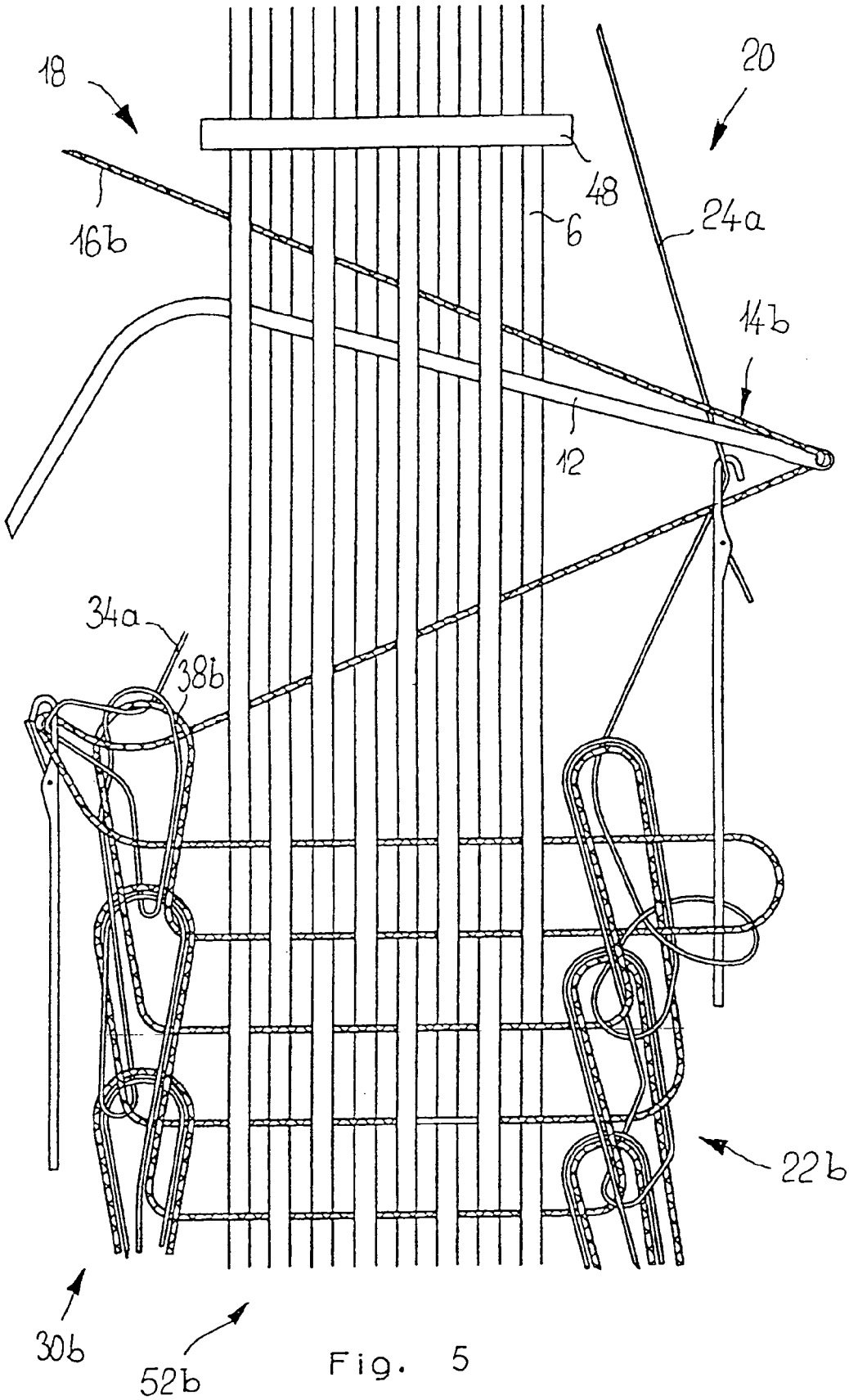
FIG. 5 shows the construction of a third ribbon fabric, in which an interlacing thread and the weft thread are interlaced on both sides with themselves, according to the Müller weaving system III.

FIG. 5 shows a third ribbon fabric 52*b*, in which the weft thread loop 14*b* introduced into the shed by means of the weft insertion needle 12 is provided on the insertion side 18 and on the discharge side 20 in each case with interlacings 30*b* and 22*b* which are formed from the interlacing threads 34*a*, 24*a* and the weft thread 16*b* which are therefore interlaced with one another in parallel. This is, here, the Müller weaving system III in KIPP, loc. cit., page 86.

Figure 6:
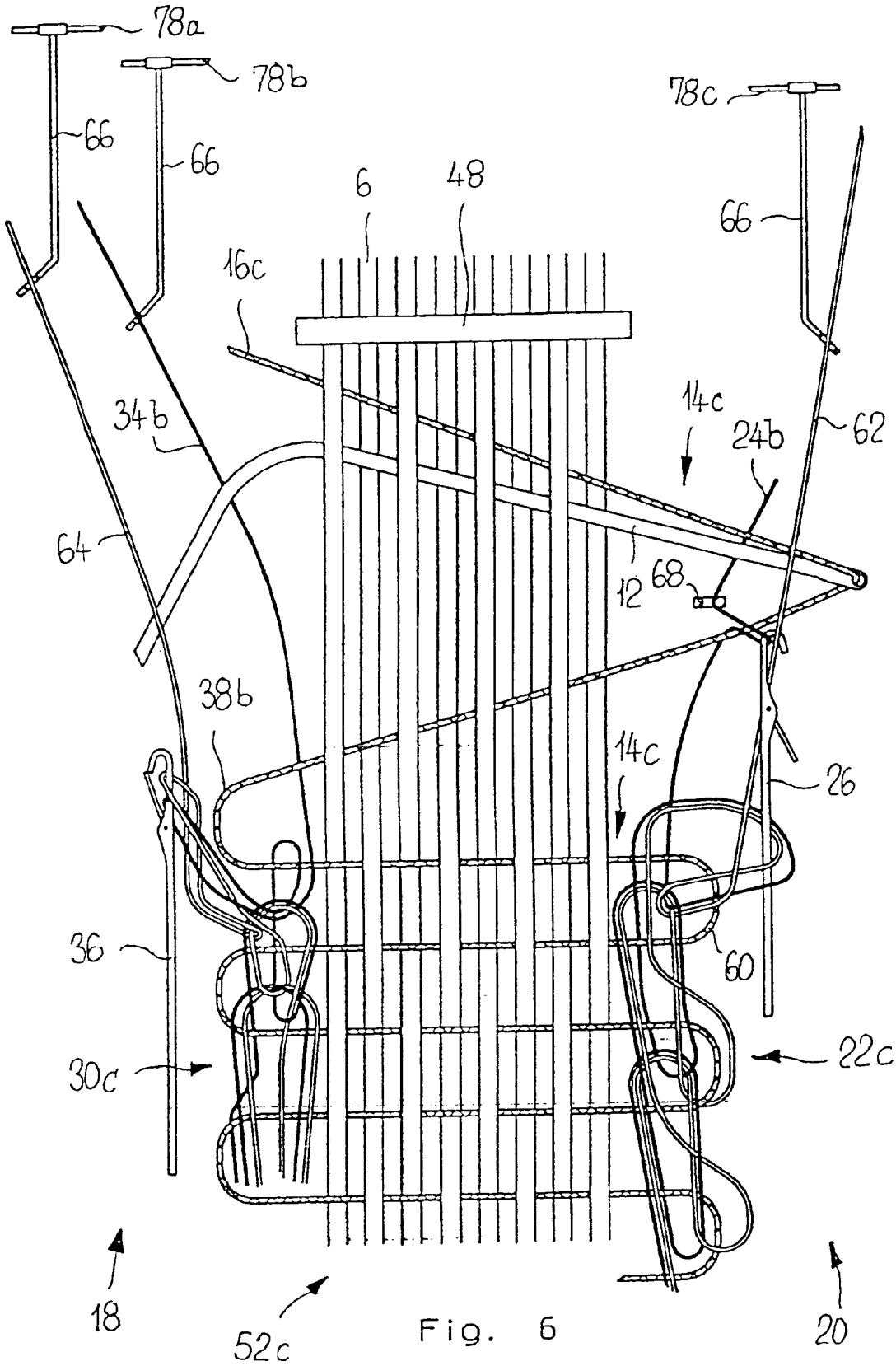
FIG. 6 shows the construction of a fourth ribbon fabric, in which interlacing threads and blocking threads are interlaced with one another on both sides, according to the Müller weaving system V.

FIG. 6 shows a fourth ribbon fabric 52*c*, in which, once again, a preferably monofilament weft thread 16*c* in the form of a weft thread loop 14*c* is introduced into the shed 8 by means of the weft insertion needle 12. Both on the insertion side 18 and on the discharge side 20, the interlacing 30*c*, 22*c* is formed in each case from a multifilament interlacing thread 34*b* and 24*b* which in each case are guided through the connection points 38*b* of adjacent weft thread loops 14*c* or the head parts 60 of the weft thread loops, these interlacing threads 24*b*, 34*b* being interlaced by means of the first and the second knitting needle 26, 36, on the one hand, with themselves and, on the other hand with an additional second interlacing thread 62, 64. This is, in this case, the Müller weaving system V in KIPP, loc. sit., page 87. Thread guides 66 and thread placers 68 serve for feeding the various interlacing threads, so that these can be picked up by the knitting needles 26 and 36. The thread guides 66 can be driven by heddle frames or heddle carrier rails 78*a*, 78*b*, 78*c* of the shedding device 2 or be controlled by means of a separate drive.

Figure 7:
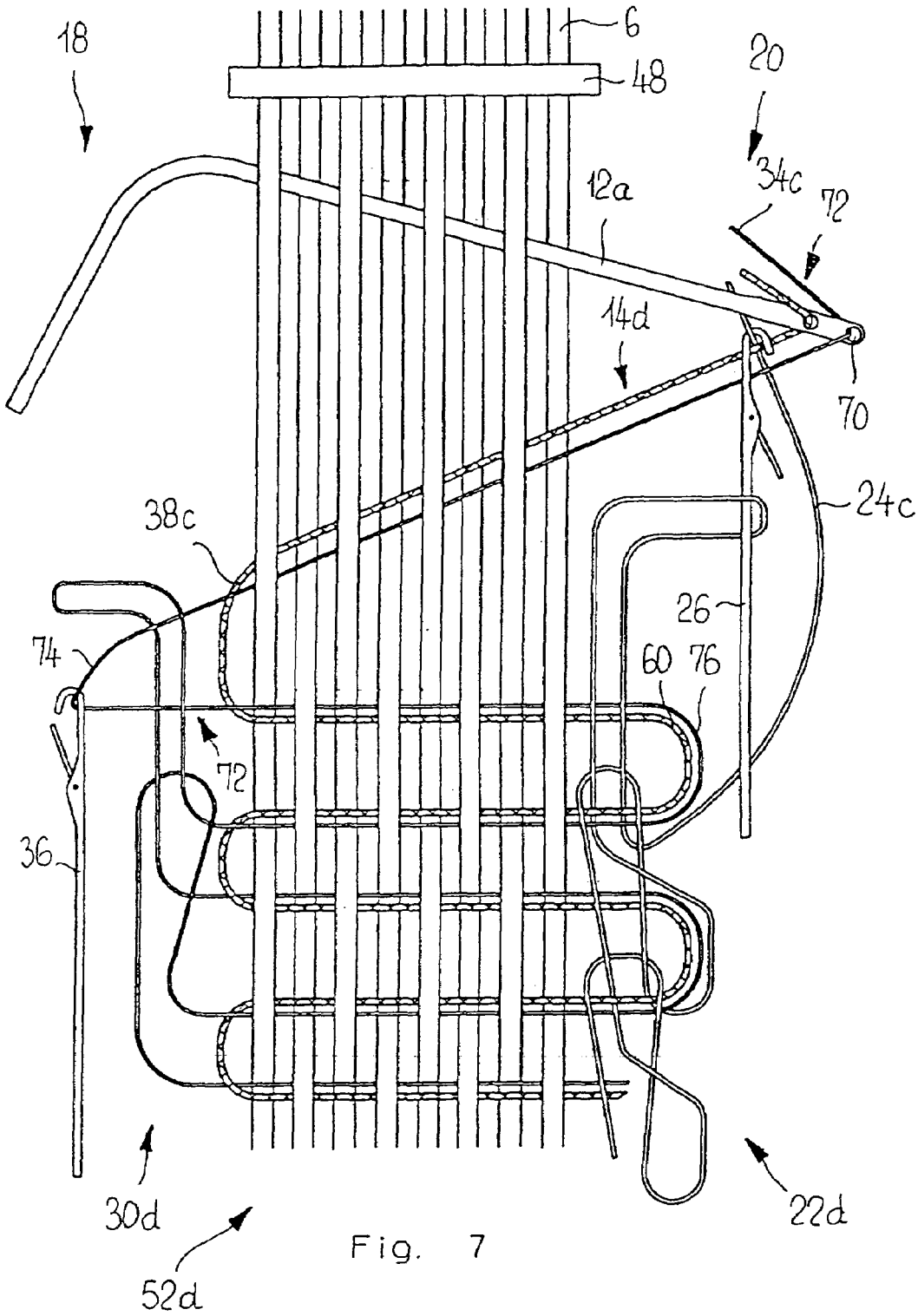
FIG. 7 shows the construction of a sixth ribbon fabric, in which a second interlacing thread is introduced together with the weft thread.

FIG. 7 shows a fifth ribbon fabric 52*d*, in which a weft insertion needle 12*a* not only introduces a weft thread loop 14*d* of a monofilament weft thread 16*d*, but is also provided with a further eye 70, in order to insert a loop 72 of a multifilament interlacing thread 34*c* into the shed simultaneously and in parallel with the weft thread loop 14*d*. This interlacing thread 34*c* is interlaced with itself on the insertion side 18 by means of the second knitting needle 36. For this purpose, the connection points 74 of adjacent loops 72 of the interlacing thread 34*c* are interlaced with one another outside the connection point 38*c* of adjacent weft thread loops 14*d*. This interlacing 30*d* therefore lies outside, beyond the connection points 38*c* of the weft thread loops 14*d* on the insertion side 18. On the discharge side 20, the interlacing 22*d* is formed by the interlacing thread 24*c* which is simultaneously drawn in each case through the head part 60 of the weft thread loop 14*d* and the head part 76 of the loop 72 of the interlacing thread 34*c* and is interlaced with itself.

In the exemplary embodiments, the knitting needles are preferably latch needles, but other knitting needles, such as, in particular, compound needles may also be used.

Many other design variants may also be envisaged, in particular the interlacings on the insertion side do not have to be identical to the interlacings on the discharge side, but different systems may be employed on both sides. At the same time, the weft threads may be of the multifilament type, but they are preferably of the monofilament type. By contrast, the interlacing threads are, as a rule, multifilament threads which by virtue of their flexibility can be adapted more easily to the interlacing patterns.

LIST OF REFERENCE SYMBOLS

2 shedding device
4 heddle
6 warp thread
8 shed
10 axis
12 weft insertion needle
12*a* weft insertion needle
14 weft thread loop
14*a* weft thread loop
14*b* weft thread loop
14*c* weft thread loop
14*d* weft thread loop
16 weft thread
16*a* weft thread
16*b* weft thread
16*c* weft thread
16*d* weft thread
18 insertion side
20 discharge side
22 interlacing
22*a* interlacing
22*b* interlacing
22*c* interlacing
22*d* interlacing
24 interlacing thread
24*a* interlacing thread
24*b* interlacing thread
24*c* interlacing thread
24*d* interlacing thread
25 thread guide
26 first knitting needle
28 loop
30 interlacing
30*a* interlacing
30*b* interlacing
30*c* interlacing
30*d* interlacing
32 thread guide
34 interlacing thread

34*a* interlacing thread
34*b* interlacing thread
34*c* interlacing thread
36 second knitting needle
38 connection point
38*a* connection point
38*b* connection point
38*c* connection point
40 rocker
42 rocker
44 shaft
46 shaft
47 axis of rotation
48 weaving reed
50 beating-up edge
52 ribbon fabric
52*a* ribbon fabric
52*b* ribbon fabric
52*c* ribbon fabric
52*d* ribbon fabric
54 ribbon guide
56 stitch knocking-over plate
58 stitch knocking-over plate
60 head part
62 second interlacing thread
64 second interlacing thread
66 thread guide
68 thread placer
70 eye
72 loop
74 connection points
76 head part
78*a* Heddle frame/heddle carrier rail
78*b* Heddle frame/heddle carrier rail
78*c* Heddle frame/heddle carrier rail

The invention claimed is:

1. A needle-type ribbon weaving machine for producing a ribbon fabric, with a shedding device (2) forming a shed (8) and with a weft insertion needle (12, 12*a*) for at least one weft thread loop (14, 14*a*, 14*b*, 14*c*, 14*d*) and with a knitting needle (26) for securing the weft thread loop (14, 14*a*, 14*b*, 14*c*, 14*d*), said knitting needle being arranged on the discharge side (20) of the shed (8) facing away from the insertion side (18) of the weft insertion needle (12, 12*a*), a further second knitting needle (36) for interlacing (30, 30*a*, 30*b*, 30*c*, 30*d*) being arranged on the insertion side (18) of the weft insertion needle (12, 12*a*), whereby the knitting needles for the insertion side (18) and the discharge side (20) are arranged pivotable about the same axis of rotation (47), wherein at least one interlacing thread (34*c*) can be introduced as a loon (72) into the shed (8) in parallel with the weft thread loon (14*d*), whereby the weft insertion needle (12*a*) has a further guide eye (70) for the interlacing thread (34*c*) to be inserted as a loop (72).

2. A needle-type ribbon weaving machine as claimed in claim 1, whereby at least one of the threads to be interlaced can be guided by means of a thread guide connected to the shedding device (78*a*, 78*b*, 78*c*), preferably to a heddle frame of the shedding device.

3. A needle-type ribbon weaving machine as claimed in claim 1, whereby the knitting needles (26, 36) of the insertion side (18) and of the discharge side (20) are arranged so as to operate with a phase displacement of 90.degree. to 270.degree., preferably of 180.degree.

4. A needle-type ribbon weaving machine as claimed in claim 1, whereby each knitting needle (26, 36) is assigned a stitch knocking-over plate (56, 58).

5. The needle-type ribbon weaving machine as claimed in 1, whereby it has a ribbon guide (54) which is assigned to the beating-up edge (50) and which extends at most over the entire width of the ribbon fabric (52, 52*a*, 52*b*, 52*c*, 52*d*) to be produced.

6. The ribbon fabric produced by a needle-type ribbon weaving machine as claimed in claim 3, said ribbon fabric having weft thread loops (14, 14*a*, 14*b*, 14*c*, 14*d*) which are woven into warp threads (6) and which run over the entire width of the ribbon fabric (52, 52*a*, 52*b*, 52*c*, 52*d*) and are tied up on the insertion side (18) and on the discharge side (20) facing away from the latter by means of interlacing (22, 22*a*, 22*b*, 22*c*, 22*d*, 30, 30*a*, 30*b*, 30*c*, 30*d*) with themselves and/or with at least one interlacing thread (34, 34*a*, 34*b*, 34*c*, 64), whereby the weft thread (16, 16*a*, 16*b*, 16*c*, 16*d*) is a monofilament thread and the interlaced threads (24, 24*a*, 24*b*, 24*c*, 34, 34*a*, 34*b*, 34*c*, 62, 64) are multifilament threads, whereby the interlacing (30, 30*b*, 30*c*, 30*d*) on the insertion side (18) is formed by an additional interlacing thread (34, 34*a*, 34*b*, 34*c*) between the connection points (38, 38*b*, 38*c*) of adjacent weft thread loops (14, 14*b*, 14*c*, 14*d*).

7. The ribbon fabric as claimed in claim 6, characterized in that it has on the insertion side (18) a further interlacing thread (64) which is interlaced with the first interlacing thread (34*b*).

8. The ribbon fabric as claimed in one of claim 6, whereby an interlacing thread (34*c*) is arranged as a loop (72) in the shed (8) in parallel with the weft thread loop (14*d*) and is interlaced on the discharge side (20).

* * * * *